United States Patent [19]

Bradley

[11] Patent Number: 4,733,240

[45] Date of Patent: Mar. 22, 1988

[54] PHASED ARRAY TRANSMITTER

[75] Inventor: Caleb R. Bradley, Oslo, Norway

[73] Assignee: The Marconi Company Limited, Stanmore, England

[21] Appl. No.: 4,011

[22] Filed: Jan. 16, 1987

[30] Foreign Application Priority Data

Jan. 18, 1986 [GB] United Kingdom ..... 8601214

[51] Int. Cl.[4] ..... H01Q 3/22; H01Q 3/24; H01Q 3/26

[52] U.S. Cl. ..... 342/372; 455/113; 328/155

[58] Field of Search ..... 342/372; 455/110, 113; 328/155

[56] References Cited

FOREIGN PATENT DOCUMENTS 1468044 3/1977 United Kingdom .
2056781 3/1981 United Kingdom .

*Primary Examiner*—Theodore M. Blum
*Attorney, Agent, or Firm*—Spencer & Frank

[57] ABSTRACT

In a phased array antenna the phase of the signal applied to each antenna element is controlled by a phase lock loop which is locked to the frequency of a reference oscillator but whose phase is offset from it alternatively by introducing a DC offset to an integrator within the phase lock loop or by presenting a digital code to a counter circuit.

4 Claims, 3 Drawing Figures

PHASED ARRAY TRANSMITTER

This invention relates to a phased array transmitter or receiver and is particularly applicable to a radar system. It could, however also be applied to an acoustic system e.g. sonar.

In a phased array transmitter there are a number of antenna elements and means for controlling the phase of energy fed to or received from each element in such a way as to give the antenna a required directional sensitivity pattern. This may for example be a single beam or a number of beams and the beam or beams can be made to change direction if required. The phase control is conventionally obtained by passing energy to be transmitted from a common source through separate branch lines containing phase shifters. The phase shifters usually comprise switches which divert the energy through one or more of a number of lines having different lengths so as to produce the required phase shift.

In a phased array receiver the same type of phase shifter may be used, with signals from the antenna elements being passed through respective phase shifters and then combined.

A limitation of the conventional techniques described above is that the phase shifters are able to produce only discrete phase changes between particular values.

Another technique which has been given theoretical consideration (e.g. as described in U.K. patent specification No. 2056781) is to employ phase lock loops to control the phases at respective antenna elements. Such an arrangement is shown in FIG. 1.

A reference frequency which is common to all the antenna elements is applied to a mixer which provides an average output voltage which is dependent on the phase difference between its two inputs. This is applied (via an adder which will be described later) to the input of a VCO whose output passes to the antenna element and also passes through optional dividers or frequency converters back to the phase comparator. The action of the loop is to lock the frequency of the VCO to the reference frequency. In the system of FIG. 1 as described so far the phase of the VCO relative to the reference frequency depends on many factors such as the values of components within the phase comparator and VCO, which may not be accurately known.

Figure 1:
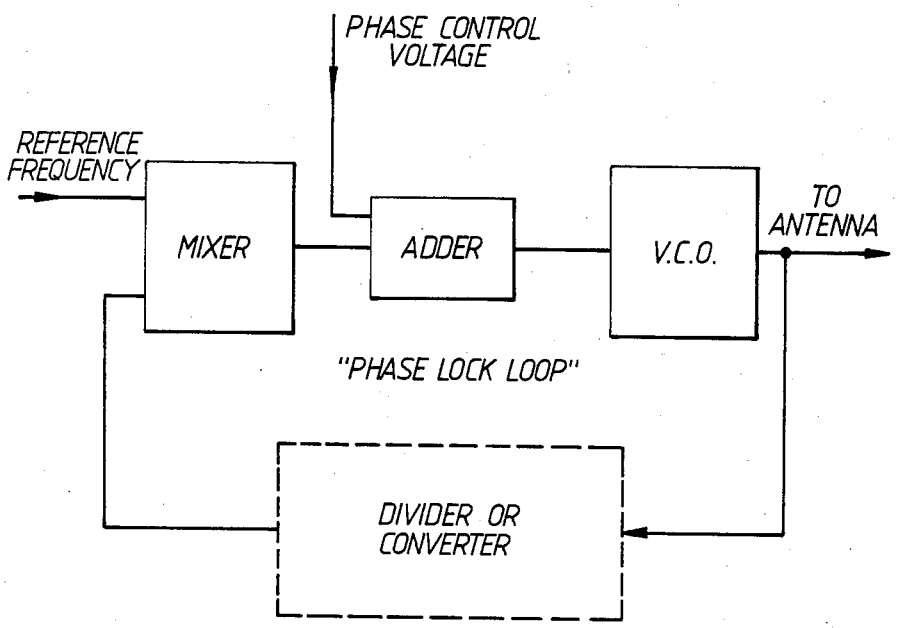
FIG. 1. PRIOR ART

A method of controlling the phase, which has been considered is to add an offset voltage to the output of the phase comparator before it passes to the VCO as shown in FIG. 1, different offsets being applied for different antenna elements. The offset voltage causes the loop to re-stabilize at a different point on the phase comparator's characteristic curve, which different point corresponds to a different phase relationship between its inputs; and therefore the VCO phase relative to the reference frequency has been changed. There are several problems with this technique.

(i) The phase before application of the offset may not be accurately known as mentioned previously and therefore the phase after application of the offset may not accurately be known either.

(ii) The phase comparator will only be usable over a limited range where it is reasonably linear. This limits the range of phase control obtainable.

(iii) The dependence of the VCO phase on the phase control voltage depends on the characteristics of the phase comparator, which may not be accurately known.

This invention provides a phased array transmitter comprising: a reference oscillator, an array of antenna elements; for each element a phase lock loop comprising a voltage controlled oscillator whose output is connected to the associated element, and a phase comparator arranged to compare a signal derived from the output of the voltage controlled oscillator with a signal derived from the reference oscillator, and control means for controlling the phases at which the oscillators lock; characterised in that the control means comprises a circuit located between the phase comparator and the voltage controlled oscillator which circuit performs a sum-and-integrate function on voltages received from (i) the phase comparator and (ii) a phase control input to the loop.

Because of the use of the aforementioned sum-and-integrate function the aforementioned problems (i) can be overcome because the phase of the oscillator before application of the phase control input is accurately known. It is accurately known because the output voltage of the phase comparator is accurately defined as equal to a reference voltage of the sum-and-integrate circuit. Furthermore by employing a phase comparator using digital components, instead of a mixer which is conventional, the problems ii and iii can also be overcome. This is because digital phase comparators can provide a linear characteristic over 360°.

According to another aspect of the invention there is provided a phased array transmitter comprising: a reference oscillator, an array of antenna elements; for each element a phase lock loop comprising a voltage controlled oscillator whose output is connected to the associated element, and a phase comparator arranged to compare a signal derived from the output of the voltage controlled oscillator with a signal derived from the reference oscillator, and control means for controlling the phases at which oscillators lock; characterised by means for processing the output of the voltage controlled oscillator to reduce the frequency thereof; a counter for counting cycles of the reference oscillator; a digital word comparator for comparing the content of the counter with a phase control input word to provide a pulse, when its inputs are equal, the phase comparator being arranged to compare the phase of the reduced frequency signal with the phase of the pulses at the output of the comparator.

By employing this second aspect of the invention the problem mentioned at (ii) above can be removed because the phase comparator always stabilizes with the same phase difference between its inputs. Also problem (iii) can be avoided because now the VCO phase no longer depends on the phase comparator characteristic and is instead accurately determined by the digital counter and comparator circuit.

The sample and hold circuit performs the function of mixing the VCO frequency with a harmonic of the reference frequency which controls it in order to convert a high (e.g. microwave) VCO frequency to a lower frequency suitable for digital processing.

Whilst a sample and hold circuit is preferred it would be possible instead to use a mixer or a divider.

In a preferred embodiment of the invention both aspects of the invention as defined above can be employed. In such an arrangement the second aspect of the invention can be used to provide a stepwise adjustment of phase and the first aspect to give a fine adjustment between steps. This will become apparent from the following description but it is emphasized that either aspect can be used alone.

Figure 2:
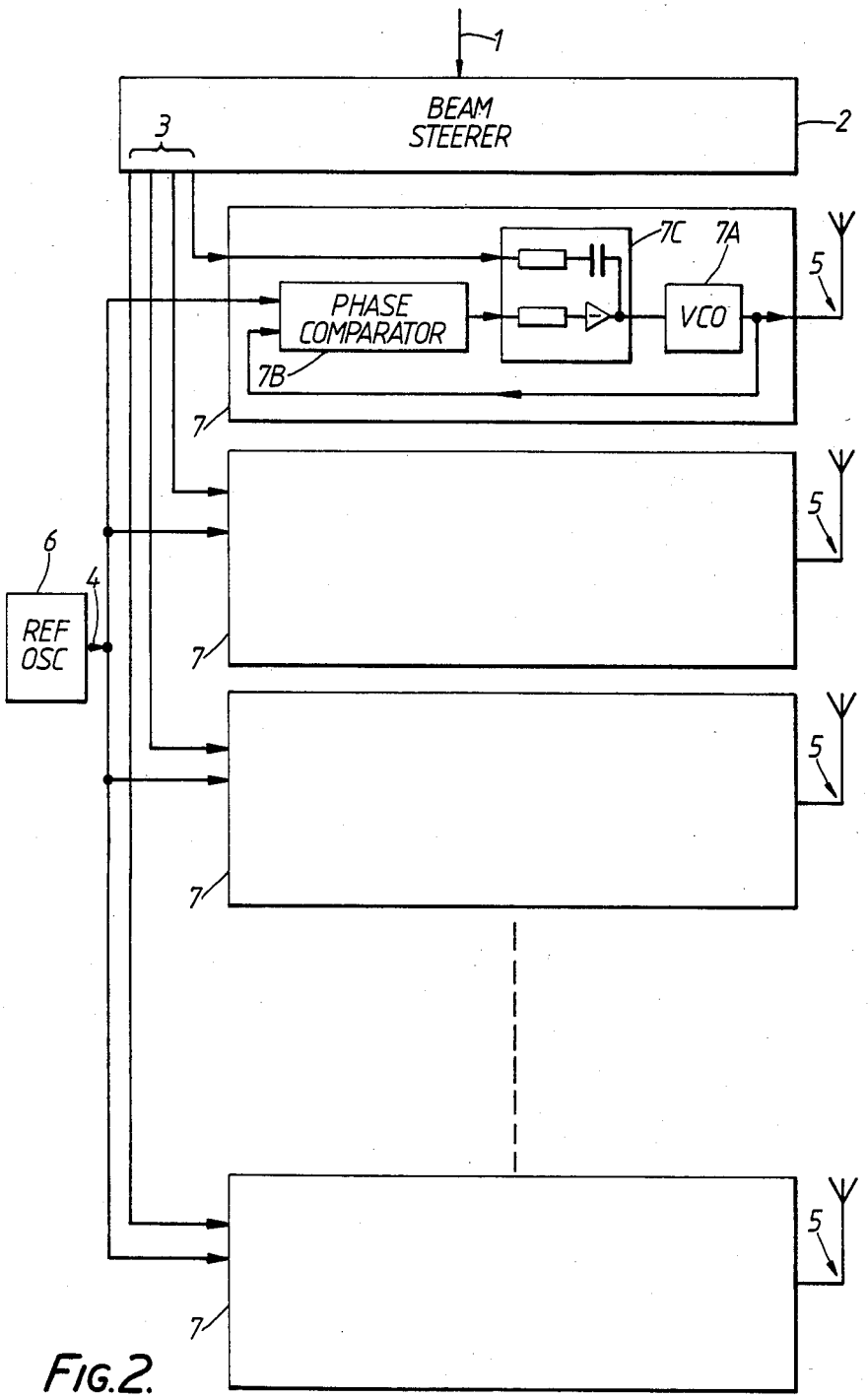
Figure 3:
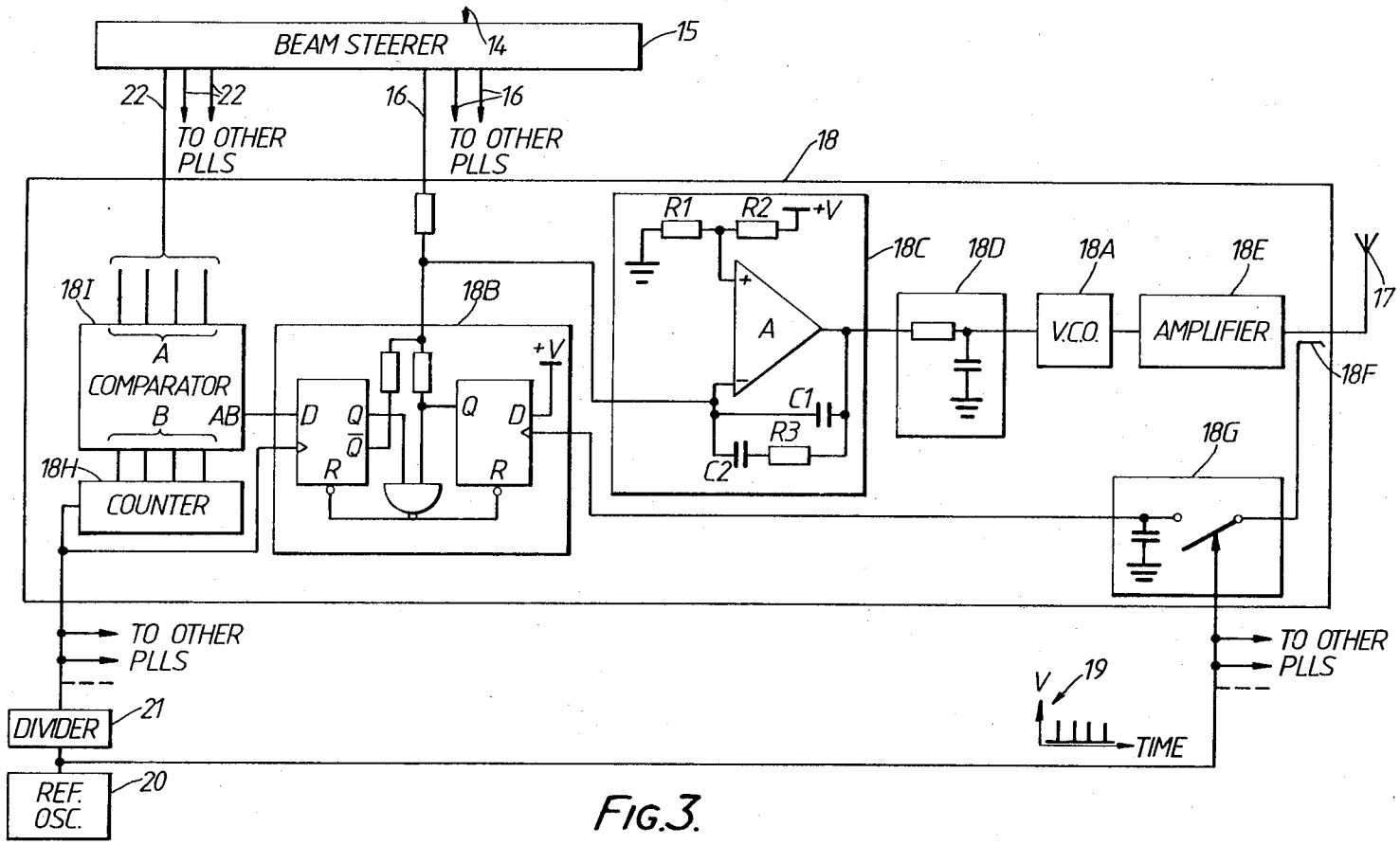

Two ways of performing the invention will now be described by way of example with reference to FIGS. 2 to 4 of the accompanying drawings in which:

FIG. 2 is a block diagram of part of a transmitter constructed in accordance with the first mentioned aspect of the invention; and FIG. 3 shows another embodiment, employing both aspects of the invention, this also being used for transmission.

Referring to FIG. 2 input data is applied on line 1 to a beam steering device 2. The input data defines at any time the required directional characteristics of an antenna. The beam steerer 2 produces, in response to the data applied at 1, phase control signals on lines 3. These signals are analogue voltage values which control proportionally the phases of energy applied to individual elements of the antenna.

In the drawing only three lines 3 for three respective elements are shown but it is to be understood that there are in fact many more.

Each phase control signal on a line 3, together with a reference signal 4 from a fixed frequency oscillator 6 is passed to a phase lock loop 7. One such phase lock loop is provided for each antenna element 5. They are all the same and so only one is illustrated in detail. This comprises a voltage controlled oscillator 7A whose output is split between the antenna element 5 and a phase sensitive detector 7B where it is compared with the phase of the signal from the reference oscillator 6 to produce a voltage whose mean value represents the relative phase of oscillators 6 and 7A. The output of the phase comparator is applied to one input of a sum-and-integrate circuit 7C whose other input is a voltage on a line 3. The circuit 7C may comprise a differential amplifier with feedback connection as described in the book "Analysis and Design of Electronic Circuits" page 438–441 by P. M. Chirlian, McGraw Hill 1965. The output of circuit 7C is a voltage which controls the oscillator 7A with correct polarity to cause the loop to stabilise. In this way the phase of the oscillator 7A is offset from the reference oscillator 6 by an amount dictated by the voltage on line 3. The desirable feature of accurate proportionality of phase offset to voltage is obtainable by using first an integrator 7C with very high gain at d.c. and second a phase comparator with a wide linear range.

FIG. 3 is a block diagram of another transmitter constructed in accordance with the invention. Data is applied on line 14 to a beam steering device 15 which produces phase control signals on lines 16, one for each of a large number of antenna elements of which only one is shown at 17.

Each antenna element has a phase control circuit 18 (only one being shown) which receives a phase control signal from the appropriate line 16. The circuit 18 contains a voltage controlled oscillator 18A, a phase sensitive detector 18B and an integrator 18C similar in function to the components 7A, 7B and 7C of FIG. 1. Integrator 18C comprises a differential amplifier A with resistors R1 and R2 to provide a reference voltage between the binary high and low levels of the logic circuits in 18B, and components C1, C2, R3 which are chosen for loop stability in accordance with conventional design methods. The phase sensitive detector 18B is a digital type which compares the times of signal swings at its two inputs and delivers a pulse to the integrator 18C of duration equal to the delay between the said swings and of polarity dependent on which swing arrived first. The circuit 18B cna consist of two D-type flip-flops (7474) and one NAND gate (7400) connected as shown, where the numbers of standrd TTL components described in the book: "The TTL Data Book for Design Engineers," cc-411 1975, Texas Instruments are given in brackets.

A low-pass filter 18D reduces unwanted phase modulation of the oscillator 18A caused by incomplete smoothing of phase detector pulses by integrator 18C. An amplifier 18E provides the required transmit power to antenna element 17.

A sample of the output signal is obtained by a directional coupler 18F and is fed to a sample-and-hold circuit 18G which is driven by pulses 19 from a reference oscillator 20 similar in function to the oscillator 6 of FIG. 1. The effect of circuit 18G is to convert the output frequency to a lower frequency at which circuits 18B, 18H and 18I can function and it may be regarded as a lossless mixer. Reference oscillator 20 also feeds a divider 21 whose output is distributed to all the loops 18 where it serves as a clock input to a digital counter 18H (74161) and to the phase sensitive detector 18B which receives a reference pulse from a digital comparator 18I (7485) once in every cycle of counter 18H when the state of counter 18H equals a digital word sent by beam steerer 15 on lines 22 each of which has four conductors.

This arrangement provides two means of controlling the phase of energy at antenna element 17, namely by a voltage on a line 16 which causes a proportional phase change and by a four bit digital word on a line 22 which gives a choice of 16 discrete phases. This number can be varied at will by design of counter 18H and comparator 18I. The said two means can be used separately or together.

The positioning of the amplifier 19E within the phase lock loop, rather than between the phase lock loop and the antenna element is advantageous because it eliminates problems which would otherwise occur as a result of unpredictable phase shifts within the amplifiers.

Phase lock loops like those shown at 7 in FIG. 2 or 18 in FIG. 3 can be used as local oscillators in phased array receivers to achieve the same benefits as have been described for transmitters.

I claim:

1. A phased array transmitter comprising: a reference oscillator, an array of antenna elements; for each element a phase lock loop comprising a voltage controlled oscillator whose output is connected to the associated element, and a phase comparator arranged to compare a signal derived from the output of the voltage controlled oscillator with a signal derived from the reference oscillator, and control means for controlling the phases at which the oscillators lock; characterised in that the control means comprises a circuit located between the phase comparator and the voltage controlled oscillator which circuit performs a sum-and-integrate function on voltages received from (i) the phase comparator and (ii) a phase control input to the loop.

2. A phased array transmitter according to claim 1 in which the phase comparator is digital.

3. A phased array transmitter comprising: a reference oscillator, an array of antenna elements; for each element a phase lock loop comprising a voltage controlled oscillator whose output is connected to the associated element, and a phase comparator arranged to compare a signal derived from the output of the voltage controlled oscillator with a signal derived from the reference oscillator, and control means for controlling the phases at which oscillators lock; characterised by means for processing the output of the voltage controlled oscillator to reduce the frequency thereof; a counter for counting cycles of the reference oscillator; a digital word comparator for comparing the content of the counter with a phase control input word to provide a pulse, when its inputs are equal, the phase comparator being arranged to compare the phase of the reduced frequency signal with the phase of the pulses at the output of the comparator.

4. A phased array transmitter according to claim 3 in which the means for processing the output of the VCO is a sample and hold circuit controlled by the reference oscillator so that on each cycle thereof it samples the output of the voltage controlled oscillator and presents it to the phase comparator.

* * * * *